US006419768B1

(12) United States Patent
Tverberg

(10) Patent No.: US 6,419,768 B1
(45) Date of Patent: Jul. 16, 2002

(54) METHOD FOR PRODUCING WELDED TUBING HAVING A UNIFORM MICROSTRUCTURE

(75) Inventor: John C. Tverberg, Mukwonago, WI (US)

(73) Assignee: Crucible Materials Corp., Syracuse, NY (US)

( * ) Notice: Subject to any disclaimer, the term of this patent is extended or adjusted under 35 U.S.C. 154(b) by 0 days.

(21) Appl. No.: 09/770,211

(22) Filed: Jan. 29, 2001

(51) Int. Cl.[7] ..... C21D 8/10

(52) U.S. Cl. ..... 148/519; 148/521; 148/593

(58) Field of Search ..... 148/519, 521, 148/593

(56) References Cited

U.S. PATENT DOCUMENTS

| | | | | | |
|---|---|---|---|---|---|
| 3,486,219 | A | * | 12/1969 | Davies et al. | 148/521 |
| 4,690,716 | A | * | 9/1987 | Sabol et al. | 148/520 |
| 5,226,981 | A | * | 7/1993 | Meredith et al. | 148/520 |
| 6,103,027 | A | * | 8/2000 | Glasier et al. | 148/519 |
| 6,290,788 | B1 | * | 9/2001 | Claus et al. | 148/593 |

* cited by examiner

*Primary Examiner*—George Wyszomierski
(74) *Attorney, Agent, or Firm*—Finnegan, Henderson, Farabow, Garrett & Dunner, L.L.P.

(57) ABSTRACT

A method for producing an autogenous welded tubular metal article having a substantially uniform grain size, including the weld-affected area thereof. This is achieved by applying to the metal article a series of cold reduction and annealing operations that in combination render the grain size of the weld-affected area uniform with respect to the remainder of the cross-section of the article, and particular the visual appearance of the cross-section.

10 Claims, No Drawings

METHOD FOR PRODUCING WELDED TUBING HAVING A UNIFORM MICROSTRUCTURE

BACKGROUND OF THE INVENTION

1. Field of the Invention

The invention relates to a method that applies a combination of cold working and heat treating operations to longitudinally welded metal tubing, particularly stainless steel tubing, to produce a grain size that is uniform throughout the tubing, and particularly, wherein the weld-affected zone has a grain size essentially the same as that of the remainder of the tubing.

2. Description of the Prior Art

A known method for producing metal tubing, and particularly stainless steel tubing, is by longitudinal autogenous welding of stainless steel strip that has been formed into the desired tubular configuration. For most applications, the resulting longitudinally welded tube is heat treated to redissolve any undesirable second phases that precipitated either during solidification of the weld or by the action of the residual heat from welding on the base metal. Some applications require simultaneous cold-reduction of the tube wall and diameter to achieve desired properties or dimensions in the final tubular article. Heat treatment may or may not follow this operation, depending upon the ultimate use and desired properties of the tubular article.

The structure of the weld affected area of the welded tube differs from that of the parent or base metal constituting the remainder of the tube in that the grain structure usually is of a different size and metallurgical structure. The weld area is clearly visible in a polished cross-section of a tube and these structural characteristics are quite distinct. For example, lower nickel stainless steels may exhibit a large grain size in the as-welded condition and significant quantities of delta ferrite within the normal austenitic matrix. Assuming an appropriate heat treatment, the grains recrystallize into smaller grains and the secondary phases dissolve. If the tube is then subjected to additional reductions and heat treatments, the weld still remains clearly visible, although it becomes less visible with extensive cold work and heat treating cycles.

Another method of producing metal tubing, and particularly stainless steel tubing, is by a seamless process. In this process, a block or billet of metal is heated to a very high temperature, a hole is pierced into the billet, and the billet is reheated to hot extrusion temperature. After thermal equilibrium is achieved, the billet is lubricated on both the outside and inside. A mandrel is inserted into the hole, the billet and mandrel are inserted into a high pressure container, a hydraulic ram is pushed against the billet and the billet is forced through a small diameter die to form a tube hollow. This tube hollow is water quenched to remove the lubricant, then surface machined on both the outside and inside to remove extrusion defects and to correct any eccentricity of the tube wall. Next, the tube is reduced in wall thickness and diameter, with appropriate intermediate heat treatments. When a cross-section of a tube so produced is polished and etched, the appearance is uniform with respect to both microstructure and grain size throughout the article.

For some applications, this structural appearance is considered to be significant. In this regard, the American Society of Mechanical Engineers (ASME) in its Boiler and Pressure Vessel Code, requires the maximum allowable stress to be 85% for welded tubing; whereas, the seamless tubing requirement is 100%. The reason for this is historical, since at the time the codes were written, welded tubing was of poorer quality than that presently produced. Nevertheless, these restrictions are in effect today even though welded tubing shows no evidence of weakness in the weld either through burst tests or corrosion tests. Specifically, when subjected to a burst test, the tubing will fracture away from the weld, often on the opposite side, and when subjected to severe corrosion tests, such as boiling hydrochloric acid test referenced as ASTM A249-S7, the weld exhibits better corrosion resistance than the base metal. The reason for this is the reaction of trace amounts of nitrogen in the weld cover gas with the molten weld metal. Nitrogen is a strengthening element, and also improves the corrosion resistance of austenitic stainless steel.

OBJECTS OF THE INVENTION

It is accordingly a primary object of the present invention to provide a method that is effective for the production of welded metal tubing, particularly stainless steel tubing, that has a weld-affected area that has a microstructure that is essentially the same, particularly in visual appearance, as that of the base metal constituting the remainder of the welded tubing.

SUMMARY OF THE INVENTION

In accordance with the invention, there is provided a method for producing an autogenous welded tubular article having a substantially uniform microstructure, including the microstructure of the weld-affected area thereof. The method includes the steps of forming an elongated strip of metal into a tubular shape, with the metal being of a metallurgical composition exhibiting a substantially single, primary metallurgical phase. This tubular shape is autogenous welded at abutting edges thereof to produce a welded tubular article having a weld-affected area, with the weld-affected area having a microstructure different than the microstructure of the remainder of the article. The tubular shape is subjected only at the weld-affected area thereof to a first cold-reduction operation to produce a grain size in the weld-affected area smaller than the grain size in the remainder of the article. Thereafter, the article is subjected to a first annealing operation of a time at temperature to dissolve any secondary phase components therein. Thereafter, the article is subjected to a second cold-reduction operation wherein the article is reduced to a greater extent than in the first cold-reduction operation. Thereafter, a second annealing operation is performed with respect to the article for a time at temperature to produce grain growth therein. Then, the article is subjected to a third cold-reduction operation wherein the article is reduced to a greater extent than in the first cold-reduction operation. Thereafter, a third annealing operation is performed with respect to the article for a time at temperature, with the temperature being lower than that used in the second annealing operation, to recrystallize the article without causing significant grain growth. Thereafter, the article is subjected to a fourth cold-reduction followed by a fourth annealing for a time at temperature to produce a final grain size that is substantially uniform throughout the article, particularly from the standpoint of visual appearance.

The second cold-reduction operation preferably produces a reduction in area of the article of 30–80%.

Preferably, the second annealing operation results in a grain size of ASTM 1-0.

Preferably, the third cold-reduction operation produces a reduction in area of the article of 30–80%.

Preferably, the third annealing operation results in the grain size of ASTM 10-14.

Preferably, the fourth cold-reduction operation produces a reduction in area of the article of 20–40%.

Preferably, the fourth annealing operation results in a grain size of ASTM 5-7.

In an additional embodiment of the invention, a high temperature heat treatment is employed after the welding operation, thus eliminating a cold-reduction operation and an annealing operation. This embodiment is only effective with alloys, such as stainless steel having a delta ferrite content of less than 3%.

Specifically in this embodiment, after the first cold-reduction operation of the weld-affected area, there is provided a first annealing operation to produce grain growth. Thereafter, the article is subject to a second cold-reduction operation wherein the article is reduced to a greater extent than in the first cold-reduction operation. Thereafter, a second annealing of the article is conducted for a time at temperature lower than said first annealing temperature, to recrystallize the article without significant grain growth. Thereafter, the article is subjected to a third cold-reduction operation followed by a third annealing operation for a time at temperature to produce a final grain size that is substantially uniform throughout the article, particularly from the standpoint of visual appearance.

DESCRIPTION OF THE PREFERRED EMBODIMENTS

A preferred embodiment in accordance with the invention is designed to be effective with metals that exhibit a single metallurgical phase, such as austenitic stainless steels that are low in delta ferrite and that do not precipitate secondary phases such as sigma or chi. Precipitates within the weld zone should be amenable to being dissolved at elevated temperatures and remain in solution. Consequently, refractory oxides, such as those formed when steel is deoxidized with calcium, aluminum or titanium, will not dissolve at elevated temperatures and thus will remain visible even though they may be broken up somewhat during cold-reduction operations. Therefore, deoxidation practices should be avoided in the practice of the process of the invention.

In accordance with a preferred embodiment of the invention, following autogenous welding to form a longitudinally welded tubular article, the weld bead is conditioned by cold working, such as forging or bead rolling. This operation is important because it introduces energy into the weld structure by the cold-reduction operation. Next, the tube is given a furnace anneal at temperatures and for times sufficient to dissolve second phase compounds, such as delta ferrite. At this point, the weld grain size is significantly smaller than the base metal grain size. Next, the tube is given a heavy reduction in cross-sectional area, on the order of 30–80%. The following operation is a high temperature anneal for a time sufficient to allow the grains to grow to a size of ASTM 1 to 0. For low nickel austenitic stainless steels, such as types 304, 304L, 316, 316L, 317, 317L, and 317LM, this temperature will be within the range of 2100 to 2150 F. The purpose of this treatment is to cause the weld grains to grow to a size much larger than that required in the final tube. Now the tube is given another cold-reduction in area and subjected to additional heat treatment. This heat treatment, however, is at a lower temperature wherein recrystallization is achieved but not grain growth. For lower nickel austenitic stainless steels, such as those cited above, a temperature in the range of 1750–1800 is usually sufficient. This will produce a grain size in the range of ASTM 10 to 14. The final operation is another cold-reduction, in the range of 20–40%, followed by a heat treatment in the range of 1900–1950 f. The result in grain size should be in the range of ASTM 5 to 7. Consequently, the microstructure is substantially uniform, particularly in visual appearance, throughout the entire cross-section of the article.

What is claimed is:

1. A method for producing an autogenous welded tubular article having a substantially uniform grain size, including a weld-affected area thereof, said method comprising:

forming an elongated strip of metal into a tubular shape, said metal being of a metallurgical composition exhibiting a substantially single primary metallurgical phase;

autogenous welding said tubular shape at abutting edges thereof to produce a welded tubular article having a weld-affected area, said weld-affected area having a microstructure different than a microstructure of a remainder of said article;

subjecting only said weld-affected area of said article to a first cold-reduction operation to produce a grain size in said weld-affected area smaller than grain size in said remainder of said article;

thereafter first annealing said article for a time at temperature to dissolve any secondary phase compounds therein;

thereafter subjecting said article to a second cold-reduction operation wherein said article is reduced to a greater extent than in said first cold-reduction operation;

thereafter second annealing said article for a time at temperature to produce grain growth therein;

thereafter subjecting said article to a third cold-reduction operation wherein said article is reduced to a greater extent than in said first cold-reduction operation;

thereafter third annealing said article for a time at temperature, lower than said second annealing temperature, to recrystallize said article without significant grain growth;

thereafter subjecting said article to a fourth cold-reduction operation; and thereafter fourth annealing said article for a time at temperature to produce a final grain size that is substantially uniform throughout said article.

2. The method of claim 1, wherein said second cold-reduction operation produces a reduction in area of said article of 30–80%.

3. The method of claim 1, wherein said second annealing results in a grain size of ASTM 1 to 0.

4. The method of claim 1, wherein said third cold-reduction operation produces a reduction in area of said article of 30–80%.

5. The method of claim 1, wherein said third anneal results in a grain size of ASTM 10 to 14.

6. The method of claim 1, wherein said fourth cold-reduction operation produces a reduction in area of said article of 20–40%.

7. The method of claims 1, 2, 3, 4, 5 or 6 wherein said metal is an austenitic stainless steel.

8. The method of claim 1, wherein said fourth anneal results in a grain size of ASTM 5 to 7.

9. A method for producing an autogenous welded article having a substantially uniform grain size, including a weld-affected area thereof, said method comprising:

forming an elongated strip of metal into a tubular shape, said metal being of a metallurgical composition exhibiting a single, primary metallurgical phase and having a delta ferrite content of less than 3%;

autogenous welding said tubular shape at abutting edges thereof to produce a welded tubular article having a weld-affected area, said weld affected area having a microstructure different than a microstructure of a remainder of said article;

subjecting only said weld-affected area of said article to a first cold-reduction operation to produce a grain size in said weld-affected area smaller than grain size in said remainder of said article;

thereafter first annealing said article for a time at temperature to produce grain growth therein;

thereafter subjecting said article to a second cold-reduction operation wherein said article is reduced to a greater extent than in said first cold-reduction operation;

thereafter second annealing said article for a time at temperature, lower than said first annealing temperature, to recrystallize said article without significant grain growth;

thereafter subjecting said article to a third cold-reduction operation; and thereafter third annealing said article for a time at temperature to produce a final grain size that is substantially uniform throughout said article.

10. The method of claim 9, wherein said metal is an austenitic stainless steel.

* * * * *